US005167456A

United States Patent [19]

Murakoshi et al.

[11] Patent Number: 5,167,456

[45] Date of Patent: Dec. 1, 1992

[54] COLOR THERMAL PRINTER

[75] Inventors: Makoto Murakoshi; Masamichi Sato, both of Tokyo, Japan

[73] Assignee: Fuji Photo Film Co., Ltd., Kanagawa, Japan

[21] Appl. No.: 832,395

[22] Filed: Feb. 7, 1992

[30] Foreign Application Priority Data

Feb. 12, 1991 [JP] Japan ..... 3-41062

[51] Int. Cl.[5] ..... B41J 3/54

[52] U.S. Cl. ..... 400/120; 400/82; 346/46

[58] Field of Search ..... 400/120, 82; 346/76 PH, 346/1.1, 46

[56] References Cited

U.S. PATENT DOCUMENTS

| | | | |
|---|---|---|---|
| 4,503,095 | 3/1985 | Seto et al. | 427/265 |
| 4,527,918 | 7/1985 | Yamamoto et al. | 400/82 |
| 4,588,315 | 5/1986 | Seto et al. | 400/120 |

FOREIGN PATENT DOCUMENTS

| | | | |
|---|---|---|---|
| 39565 | 3/1984 | Japan | 400/82 |
| 201873 | 11/1984 | Japan | 400/82 |
| 965 | 4/1985 | Japan | 400/82 |
| 8366 | 1/1986 | Japan | 400/82 |
| 171370 | 8/1986 | Japan | 400/82 |
| 211061 | 9/1986 | Japan | 400/120 |

*Primary Examiner*—Clifford D. Crowder
*Assistant Examiner*—J. R. Keating

[57] ABSTRACT

A color thermal printer has a character printing thermal head and a half-tone color image printing thermal head. The character printing thermal head records a black character on an image receiving sheet by heating the back surface of a black ink film. The half-tone color image printing thermal head records a color image on the image receiving sheet by heating the back surface of a color ink film having at least cyan, magenta, and yellow ink areas cyclically formed thereon. A heating element of the thermal head of conventional size is used for character printing, and a heating element with a smaller width than that of a conventional thermal head in the sub scan direction is used for half-tone color image printing.

1 Claim, 3 Drawing Sheets

COLOR THERMAL PRINTER

BACKGROUND OF THE INVENTION

1. Field of the Invention

The present invention relates to a color thermal printer of a thermal wax transfer type, and more particularly to a color thermal printer suitable for printing both black character hard copies and color half-tone image hard copies.

2. Description of Related Background Art

Recently, thermal printers of a thermal wax transfer type are widely used. This type of printer has a thermal head having a number of heating elements linearly disposed, and the thermal head is made in contact with the back surface of an ink film to transfer softened or melted ink to a recording sheet. Such a thermal printer includes a black-and-white thermal printer for printing black characters and line images by using a black ink film, and a color thermal printer for printing color half-tone images and color characters by using a color ink film.

A color thermal printer includes a printer with a single thermal head and a printer with a plurality of thermal heads. A color thermal printer with a single thermal head, such as disclosed in Japanese Patent Publication No. 63-65030, uses a color ink film formed thereon with cyan, magenta, yellow, and black ink areas at a constant pitch. In this case, color images and characters are recorded on a recording sheet by passing the sheet four times on the thermal head and sequentially recording four colors on the same frame. A color thermal printer with a plurality of thermal heads has a cyan thermal head for heating a cyan ink film, a magenta thermal head for heating a magenta ink film, a yellow thermal head for heating a yellow ink film, and a black thermal head for heating a black ink film. Each thermal head is provided with such a monochromatic ink film. Color images and color characters are recorded on a recording sheet at the same time for all four colors by passing the sheet only once.

A thermal printer used with a personal computer for example is used mostly for printing characters and line images by using black ink, and relatively less for printing color half-tone images. When a color printer with a single thermal head is used, black characters are printed using a black ink area while not using the other cyan, magenta and yellow ink areas. The latter ink areas are fed without contributing to printing, resulting in uneconomical use. When a color printer with four thermal heads is used, there is no wasteful area of color ink films for both black characters and color half-tone images, but the size and manufacturing cost of the printer become large because of the use of the four thermal heads. Furthermore, the width of a heating element of a conventional thermal head is comparable to the length of a virtual picture cell on a recording sheet in the sub scan direction, and each ink dot is printed on the whole area of a picture cell, so that a half-tone color, image cannot be printed without using matrix half-tone printing.

A thermal wax transfer printing method capable of printing a half-tone image has been proposed in U.S. Ser. No. 7/699.591 filed on May 14, 1991. According to this thermal wax transfer printing method, a thermal head is intermittently moved in the unit feeding length relative to a recording sheet, the unit feeding length being set shorter than the width (or length in the sub scan direction) of each heating element. Each heating element is driven on the unit feeding length to change the record length within each picture cell in the sub scan direction, in accordance with the recording density. However, the thermal head used with this thermal wax transfer printing method has a heating element whose width (or length in the sub scan direction) is narrow, leaving a problem of short lifetime and low printing speed. In practical use, printing of a half-tone color image is not frequent, but printing of characters is very often. Therefore, there arises a problem of low printing speed when characters are printed frequently.

SUMMARY OF THE INVENTION

It is a principal object of the present invention to provide a color thermal printer capable of eliminating a wasteful color ink film in printing black characters while realizing a compact size and low cost.

It is another object of the present invention to provide a color thermal printer capable of printing black characters without sacrificing printing speed and elongating the lifetime of the thermal head.

In order to achieve the above and other objects of the present invention, a printer is provided with a character printing thermal head and a color image printing thermal head. The character printing thermal head prints black characters by heating the back surface of a black ink film. The color image printing thermal head prints color images, frame-sequentially or line-sequentially, by heating the back surface of a color ink film formed with at least cyan, magenta, and yellow areas in cyclic fashion.

For printing characters a thermal head whose heating elements have a conventional width (comparable to a picture cell length in sub scan direction) is used in order to realize high speed printing and long lifetime. A heating element with a small width in the sub scan direction, however, is used when recording gray characters or half-tone black, images. A heating element of a color half-tone image printing thermal head has a small width in the sub scan direction in order to provide half-tone color images.

Black characters are printed on a sheet by heating and pressing a black ink film using the character printing thermal head. The black ink film is used only for printing black characters, eliminating a waste of ink film and realizing a compact size and low cost of the printer. It is also possible to print characters at a conventional speed by using the heating element having a conventional size. Color images are printed with a single thermal head, frame-sequentially or line-sequentially for the three colors, by using a color ink film formed with cyan, magenta, and yellow, and if necessary black, areas. Since a thermal head is not separate for each color, a compact size and low cost are realized. It is also possible to print a half-tone color image by using heating elements with a small width in the sub scan direction, although taking relatively a longer time in printing. This longer recording time poses no practical problem because most of hard copies are of black characters but less often half-tone color images.

BRIEF DESCRIPTION OF THE DRAWINGS

The above and other objects and advantages of the present invention will become apparent for those skilled in the art from the following detailed description of the invention when read in connection with the accompanying drawings, in which.

DETAILED DESCRIPTION OF THE PREFERRED EMBODIMENTS

Figure 1:
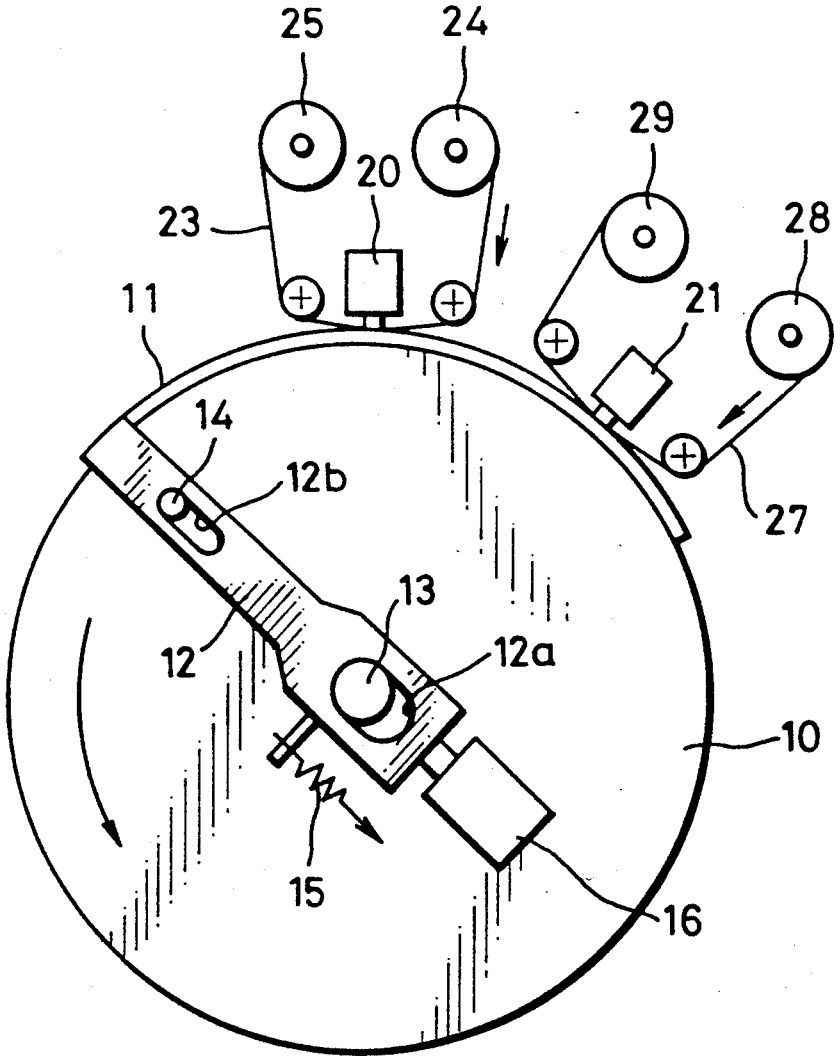
FIG. 1 is a schematic diagram showing a half-tone color thermal printer according to an embodiment of the present invention.

Referring to FIG. 1 showing a color thermal printer according to the present invention, a platen drum 10 is rotated by a pulse motor (not shown) in the sub scan direction indicated by an arrow, during thermal transfer printing, while holding an image receiving sheet 11 in position at the outer periphery of the drum. The leading edge of the sheet 11 is clamped by a clamp member 12 of a one-side open rectangular contour and held in position on the platen drum 10. The clamp member 12 has elongated holes 12*a* and 12*b* respectively loosely fitted with a platen shaft 13 and pin 14. In the normal state, the clamp member 12 takes a clamp state by means of a spring 15. When a solenoid 16 is powered, it moves to release the clamp state.

Figure 2:
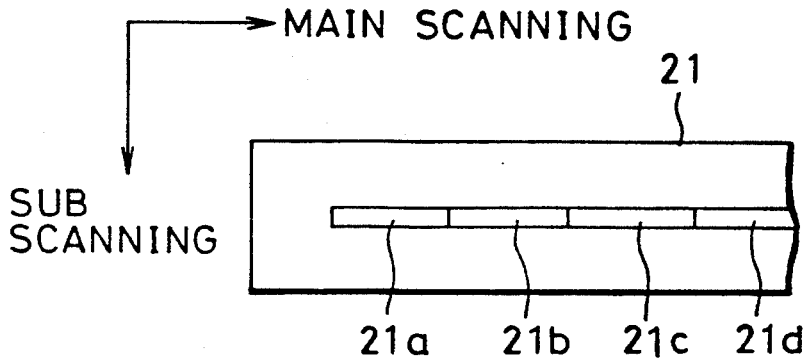
FIG. 2 is a bottom view of a thermal head for half-tone image printing.
Figure 6:
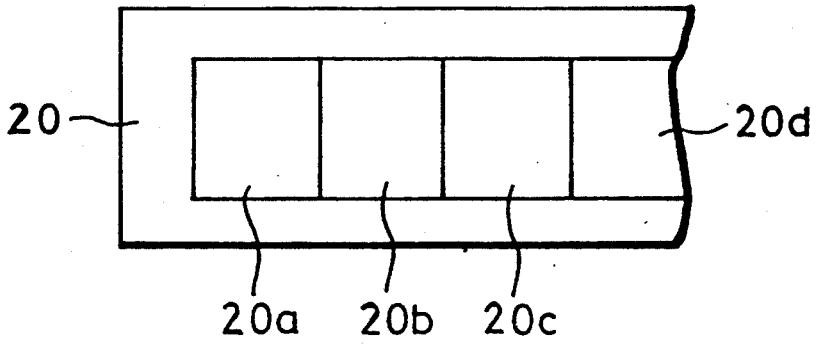
FIG. 6 is a bottom view of a character printing thermal head according to an embodiment of the present invention.

Disposed near the outer periphery of the platen drum 10 are a character printing thermal head 20 and a half-tone color image printing thermal head 21 both of which are moved toward the platen drum 10 by a pressure mechanism (not shown) only during thermal transfer printing to thereby press heating elements to the sheet 11. As shown in FIG. 6, the character printing thermal head 20 has heating elements 20*a*, 20*b* and so on of a conventional size linearly disposed in the main scan direction, the heating elements heating and pressing the back surface of a black ink film 23 to transfer black ink to the sheet 11. The black ink film 23 is pulled out of a supply reel 24 at the same speed as the rotation speed of the sheet 11, and after passing under the character printing thermal head 20, wound up about a take-up reel 25. The half-tone color image printing thermal head 21 has heating elements of a small width linearly, disposed in the main scan direction as shown in FIG. 2, the heating elements heating and pressing the back surface of a color ink film 27 to transfer color ink to the sheet 11. Reference numeral 28 represents a supply reel, and reference numeral 29 represents a take-up reel.

Figure 3:
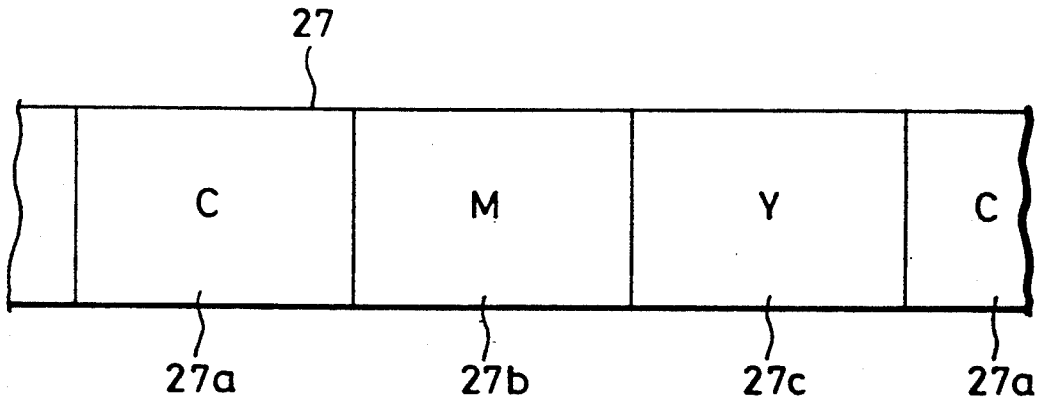
FIG. 3 is a plan view of a color ink film.

FIG. 3 shows a color ink film. The color ink film 27 is cyclically formed with cyan ink areas 27*a*, magenta ink areas 27*b*, and yellow ink areas 27*c*, each area having nearly the same size as the sheet 11. In printing a cyan image for example, the cyan ink area 27*a* moves together with the sheet 11 partially superposed each other, and during this movement, the cyan ink area 27*a* is heated and pressed by the half-tone color image thermal head 21.

Figure 4:
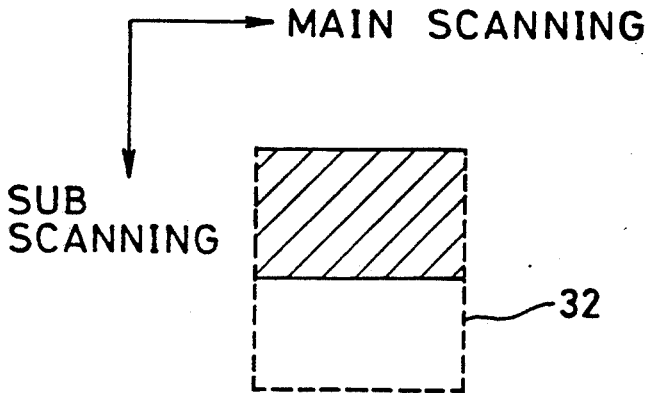
FIG. 4 illustrates a picture cell.

FIG. 4 shows a virtual picture cell on a sheet. A picture cell 32 has a size of $125 \times 125$ μm for example. An ink dot having a size such as shown indicated by a hatched area is printed within the picture cell 32. The length of the ink dot in the main scan direction is determined by the length of the heating element in the main scan direction, while its length in the sub scan direction is determined by the ON time of the heating element when continuously driven, or the number of pulses when driven by pulses. In recording a black character, black ink is transferred to the whole area of the picture cell 32. In recording a half-tone color image, the drive time is determined in accordance with the density of the picture cell to change the length of the color ink dot in the sub scan direction, to thereby realize a half-tone by changing the area of a transferred ink dot within the picture cell 32.

Figure 5:
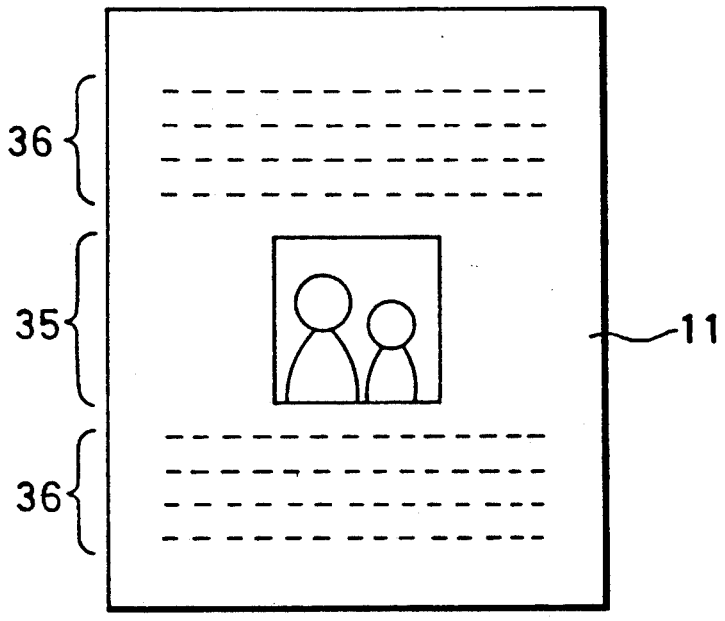
FIG. 5 is a plan view showing an example of a hard copy.

Next, printing a hard copy having both black characters and a half-tone color image such as shown in FIG. 5 will be described. The solenoid 16 is powered to move the clamp member 12, then the leading edge of a sheet 11 is inserted between the clamp member 12 and the platen drum 10. When the solenoid 16 is turned off, the clamp member 12 moves backward by means of the spring 15 to thereby clamp the leading edge of the sheet 11. During the thermal transfer printing, the platen drum 10 rotates at a constant speed in the direction indicated by the arrow. The platen drum 10 rotates quickly until the leading edge of the color image 35 reaches the thermal head 21.

When the leading edge of the color image area 35 on the sheet 11 reaches the half-tone color image printing thermal head 21 as the platen drum 10 rotates, the thermal head 21 moves toward the platen drum 10. Accordingly, the color ink film 27 is partially superposed upon the sheet 11 in alignment with the ink area to be first printed, e.g., the cyan ink area 27*a*. At this time, the take-up reel 29 starts rotating to move the color ink film 27 partially superposed upon the sheet 11. During this movement, drive signals for the first line of the cyan are supplied to the half-tone color image printing thermal head 21 to heat the heating elements and hence the back surface of the cyan ink area 27*a*. As a result, as shown in FIG. 4, cyan ink dots having different lengths in the sub scan direction satisfying the picture cell density, are transferred on the sheet 11. After the thermal transfer printing of the first line, drive signals for the second line are supplied to the half-tone color image printing thermal head 21 to print the second line of the cyan image on the sheet 11. In a similar manner, the cyan image is printed on the sheet 11 one line after another. When the trailing edge of the color image 35 on the sheet 11 passes under the thermal head 21, the thermal head 21 moves backward from the platen drum 10 to detach the color ink film 27 from the sheet 11, and the platen drum 10 is rotated quickly.

After one rotation of the platen drum 10, when the leading edge of the color image 35 on the sheet 11 reaches the thermal head 21, the thermal head 21 moves toward the platen drum 10. Accordingly, the color ink film 27 is partially superposed upon the sheet 11 in alignment with the magenta ink 27*b*. While the magenta ink area 27*b* moves together with the sheet 11, drive signals for the magenta image are supplied to the thermal head 21 to print the magenta image one line after another on the sheet 11. Similarly when the platen drum 10 again reaches the thermal head 21, the yellow ink area 27*c* is superposed upon the sheet 11 to print the yellow image on the sheet 11. After three rotations of the platen drum 10, a half-tone color image 35 is recorded on the sheet 11. During the above-described three time printing, the thermal head 20 is detached.

After color image printing when the leading edge of the printing sheet 11 reaches the character printing thermal head 20, the character printing thermal head 20 moves toward the platen drum 10. Accordingly, the black ink film 23 is partially superposed upon the sheet 11. At this time, the take-up reel 25 starts rotating to move the black ink film 23 partially superposed upon the sheet 11. The black ink film 23 is heated with the character printing thermal head 20 to transfer softened or melted black ink to the whole area of the picture cell 32 and to print black characters 36 shown in FIG. 5 on the sheet 11.

In the above-described embodiment, printing a hard copy having both characters and half-tone color images has been described. For a hard copy having only characters, the character printing thermal head 20 alone is used, and for a hard copy having only half-tone color images, the color image printing thermal head 21 alone is used. For a hard copy having color characters, the color image printing thermal head 21 is used. The color ink film 27 may be provided with a black ink area to print a color image with four colors including black. In place of the platen drum 10, a reciprocally movable table may be used. Alternatively, a thermal head of a reciprocally moving swing arm type may be used.

In the above-described embodiment, black ink is transferred to the whole area of a picture cell. Instead, black ink may be transferred to e.g. half the area of each picture cell to record a gray character. In printing a hard copy having black characters and half-tone black images mingled together, the half-tone printing thermal head 21 only may be used and the platen drum 10 is rotated only once. In this case, the printing speed is sacrificed.

When needing only a monochromatic line image or character by printing ink dots on the whole of picture cells, the color image printing thermal head 21 may use heating elements with a large width such as shown in FIG. 6. In such a case, one rotation of the platen drum 10 is made if black characters and red line images are to be printed, two rotations of the platen drum 10 is made.

In the above-described embodiment, while a printing sheet is continuously moved within each picture cell relative to a printing thermal head, each heating element is driven in accordance with the density of the picture cell. The present invention is also applicable to the case wherein a printing sheet is intermittently moved within each picture cell at a constant pitch. In this case, it is preferable to drive each heating element with pulses so that the heating elements can be powered once for each pitch. With such an intermittent scheme, a thermal head of the type shown in FIG. 6 allows a large unit feeding length for character printing, realizing high speed printing.

In the above description, the main scan direction corresponds to the direction of a heating element array, and the sub scan direction is perpendicular to the main scan direction. In the above-described embodiment, a line printer using a one-dimensional motion of a thermal head or image receiving sheet has been described. The present invention is also applicable to a serial printer using a two-dimensional motion of a thermal head or image receiving sheet. The line printer carries out a frame-sequential printing, and the serial printer carries out a line-sequential printing.

While the invention has been described in detail above with reference to the preferred embodiment, various changes and modifications within the scope and spirit of the invention will be apparent to people of working skill in this technological field. Thus, the invention should be considered as limited only by the scope of the appended claims.

We claim:

1. A color thermal printer comprising:

means for holding an image receiving sheet and for moving said image receiving sheet in a sub scan direction;

a black ink film;

first thermal head means for printing a block character on said image receiving sheet by heating the back of said black ink film;

a color ink film having at least cyan, magenta, and yellow ink areas cyclically formed thereon; and second thermal head means for printing a half-tone color image on said image receiving sheet by heating the back of said color ink film, said first and second thermal head means having a plurality of heating elements linearly disposed in a main scan direction, said heating elements of said first thermal head means having a length as measured in the sub scan direction that is greater than the lengths of said heating elements of said second thermal head means.

* * * * *